US008075109B2

(12) United States Patent
Matsui et al.

(10) Patent No.: US 8,075,109 B2
(45) Date of Patent: Dec. 13, 2011

(54) INK JET PRINTER

(75) Inventors: Yasuhiro Matsui, Hachioji (JP); Takeshi Urakami, Hachioji (JP)

(73) Assignee: Konica Minolta IJ Technologies, Inc., Hino-shi (JP)

( * ) Notice: Subject to any disclaimer, the term of this patent is extended or adjusted under 35 U.S.C. 154(b) by 322 days.

(21) Appl. No.: 12/421,722

(22) Filed: Apr. 10, 2009

(65) Prior Publication Data

US 2009/0267988 A1 Oct. 29, 2009

(30) Foreign Application Priority Data

Apr. 23, 2008 (JP) ..... JP2008-112241

(51) Int. Cl.
*B41J 2/17* (2006.01)

(52) U.S. Cl. ..... 347/84

(58) Field of Classification Search ..... 347/84–86, 347/7, 40–43
See application file for complete search history.

(56) References Cited

U.S. PATENT DOCUMENTS

| | | | |
|---|---|---|---|
| 6,024,443 | A | 2/2000 | Muhl et al. |
| 2006/0038862 | A1 | 2/2006 | Tanno |

FOREIGN PATENT DOCUMENTS

| | | | |
|---|---|---|---|
| EP | 0 854 042 | A2 | 7/1998 |
| JP | 2003-94681 | A | 4/2003 |
| WO | WO 02/34523 | A2 | 5/2002 |

OTHER PUBLICATIONS

Extended European Search Report dated Jul. 14, 2009 issued in a counterpart European Application No. 09 15 7830.

*Primary Examiner* — Lamson Nguyen
(74) *Attorney, Agent, or Firm* — Holtz, Holtz, Goodman & Chick, PC

(57) ABSTRACT

An inkjet printer, comprises a plurality of recording heads to jet ink onto a recording medium; an ink distributing device to distribute ink to the plurality of recording heads and having a damping action to the ink, the ink distributing device including, an ink chamber to store ink therein, an inlet section having an ink inlet port through which ink is fed from an outside into the ink chamber, and an outlet section having a plurality of ink outlet ports through which ink is discharged from the ink chamber; and a plurality of supplying pipes to distribute ink from the plurality of outlet ports to the plurality of recording heads.

7 Claims, 8 Drawing Sheets

INK JET PRINTER

This application is based on Japanese Patent Application No. 2008-112241 filed on Apr. 23, 2008 in Japanese Patent Office, the entire content of which is hereby incorporated by reference.

BACKGROUND OF THE INVENTION

The present invention relates to an ink jet printer, and especially relates to an ink jet printer in which plural recording heads jet out ink of the same color to perform an image recording.

As an image recording apparatus which can record an image not only on a usual record medium, such as paper and cloth, by also on a record medium having poor ink absorbability, such as a resin film and a metal, an ink jet printer has been developed so as to jet ink from nozzles provided in the end surface of recording heads and to make the ink reach on a record medium, and an at the present day the technique to use the ink jet printer has been applied to various technical fields.

In many cases, the ink jet printer is used with a line head type recording technique or a serial head type recording technique. In the line head type recording technique, a recording head is fixed at a position above a record medium, and jets ink onto the record medium being conveyed in a predetermined direction so as to conduct recording (printing). In the serial head type recording technique, a recording head jets ink onto a stopped record medium and conducts recording (printing) while the recording head is moved outward and homeward in a main scanning direction.

In such an ink jet printer, for example, in the case of a line head type, at the time of setting a record medium, at the time of a maintenance, or at a time of conducting a processing operation such as covering nozzles of a recording head with a cap in the case where there is a period of free time after the completion of a previous recording operation until the beginning of the following recording operation, if an impact force is applied onto a pipe to supply ink to a recording head by an operation to shift the recording head upward or downward or by a motion to touch the pipe, the pressure of ink in the recording head fluctuates.

Also, in a serial head type ink jet printer, at the time of setting a record medium, in addition, at the time that a recording head is moved outward and homeward at the time of recording images, the pressure of ink in the recording head fluctuates.

In the above ways, if the pressure of ink in the recording head fluctuates, ink in nozzles of the recording head is inhaled into the inside of the recording head, and simultaneously, outer air is also inhaled and mix into ink. As a result, the following trouble may be caused, ink is not jetted out from the nozzles, ink is extruded from nozzles by pressure and adheres on a nozzle surface in the vicinity of the nozzles, a meniscus of ink cannot be formed on the nozzles or ink cannot be jetted in a normal direction due to an irregular force such as a pulling force caused by a deposit of ink adhering in the vicinity of the nozzles.

In order to prevent the above trouble from occurring, there is a case, for example, that a damper is provided between a recording head and an ink tank or an intermediate tank, and the damper is adapted to absorb pressure fluctuation when the inside pressure of a recording head increases or decreases. Further, in the ink jet printer disclosed in Japanese Patent Unexamined Publication No. 2003-94681, a structure is proposed to provide an air removing device including a exhaust pipe and an exhaust valve at a location of a conventional damper in order to removing collected air.

However, in the case that two or more recording heads are provided in an ink jet printer, if such an air removing device disclosed by the above Japanese patent unexamined publication is provided for each of the two or more recording heads, the size of the ink jet printer itself becomes larger, and the manufacturing cost also increases at the same time. On the other hand, there is also a problem that air collected in a damper is not easily removed unless a device like the air removing device is provided.

Moreover, even if pressure fluctuation of a recording head is absorbed with a damper, the back pressure of each of plural recording heads does not necessarily become the same pressure. Since the amount of ink jetted out from each recording head does not necessarily become equal, a recorded image has a problem that color unevenness is caused.

SUMMARY OF THE INVENTION

Then, an object of the present invention is to provide an ink jet printer in which the back pressure of each of plural recording heads to jet out ink of the same color is made to the same pressure such that color unevenness is prevented from occurring in an image, and the size of the ink jet printer can be prevented to become larger. Moreover, it makes also as an object to provide an ink jet printer capable of removing air collected in a damper easily.

In order to achieve the above object, an inkjet printer reflecting one aspect of the present invention, comprises:

a plurality of recording heads to jet ink onto a recording medium;

an ink distributing device to distribute ink to the plurality of recording heads and having a damping action to the ink, the ink distributing device including, an ink chamber to store ink therein, an inlet section having an ink inlet port through which ink is fed from an outside into the ink chamber, and an outlet section having a plurality of ink outlet ports through which ink is discharged from the ink chamber; and a plurality of supplying pipes to distribute ink from the plurality of outlet ports to the plurality of recording heads.

DETAILED DESCRIPTION OF THE PREFERRED EMBODIMENT

Hereafter, a preferable embodiment of the present invention will be explained. However, the present invention is not limited to this embodiment.

Firstly, a preferable structure of the present invention to attain the above object will be explained.

In order to solve the above problems, an ink jet printer of the present invention equips with plural recording heads and a damper (as the above mentioned ink distributing device) to supply ink to the plural recording heads, and the above-mentioned damper comprises an ink chamber provided in its inside, an ink inlet port to make ink supplied from the outside to flow into the ink chamber, and plural ink outlet ports corresponding in number to the plural recording heads and for supplying the ink in the ink chamber to the plural recording heads respectively, the ink jet printer is characterized in that the plural ink outlet ports of the damper are connected with the plural recording heads through respective ink supply pipes.

According to the ink jet printer of the present invention, a damper is made a so-called branch-type damper (or an ink distributing device) to branch and supply ink supplied through one ink inlet port from the outside into plural recording heads to jet out ink of the same color, it becomes possible to structure that the pressure of ink in the plural recording heads to jet out ink of the same color can be adjusted by a single piece of a damper.

Therefore, the pressure of ink in the plural recording heads to jet out ink of the same color becomes the same pressure, and since the amount of ink jetted out by each recording head becomes equal, it becomes possible to prevent color unevenness appropriately from occurring in a recorded image. Moreover, since it is allowed to provide one damper for plural recording heads, it is possible to prevent the size of an ink jet printer itself from becoming larger, and also it is possible to seek to reduce the manufacturing cost.

Hereafter, an embodiment of the ink jet printer according to the present invention will described with reference to drawings.

In this embodiment, the case where a recording head 10 mentioned later is a line head type recording head will be explained.

Figure 1:
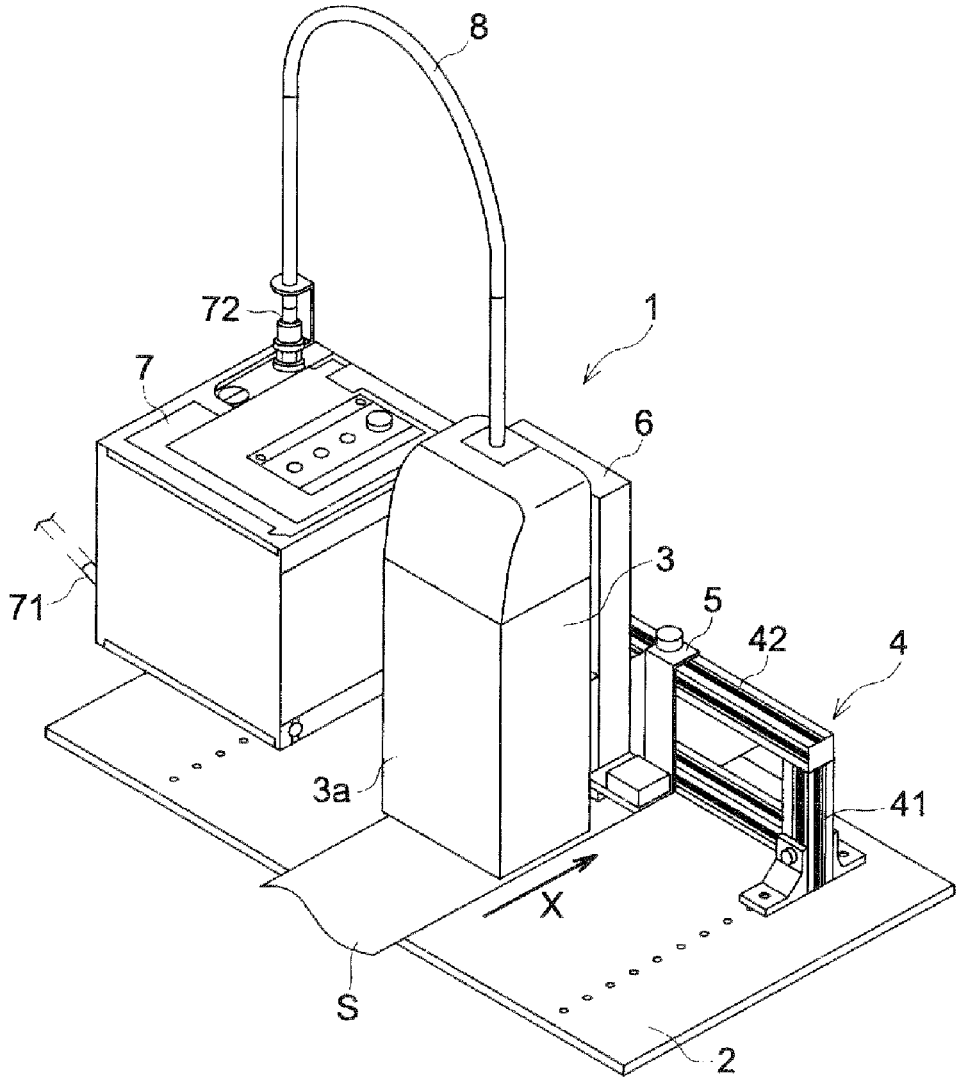
FIG. 1 is a perspective view showing a principal part structure of an ink jet printer according to this embodiment.

As shown in FIG. 1, in the ink jet printer 1 according to this embodiment, a platen 2 to support the non recording surface side of a record medium S from is arranged. At the downstream side and upstream side of the platen 2 in terms of the conveying direction of the record medium S shown with an allowed mark X in the drawing, conveying rollers (not shown in the drawing) to convey the recording medium S are arranged, and the conveying rollers are adapted to convey the recording medium S in a predetermined speed on the platen 2 by being rotated by a conveying apparatus equipped with a conveying motor (not shown in the drawing).

On the platen 2, there is provided a fixing stay 4 to arrange a head unit 3 at the predetermined location on the platen 2. The fixing stay 4 is constituted by legs 41 and a support bar 42 in the form of a Torii gate. That is, the legs 41 are fixed on the platen 2, and the support bar 42 are mounted on the legs 41 such that the support bar 42 is extended in the direction perpendicular to the conveying direction X of the recording medium S. Further, on the support bar 42 of the fixing stay 4, a support base 6 is attached with a fixing tool 5 so as to extend in the vertical direction, and a head unit 3 is mounted on the support base 6 such that the head unit is shifted upward or downward on the support base 6.

In the above structure, the positioning of the head unit 3 in the conveying direction X of the record medium S is performed by fixing the legs 41 of the fixing stay 4 at suitable locations on the platen 2, and the positioning of the head unit 3 in the direction perpendicular to the conveying direction X of the record medium S is performed by shifting the support base 6 with the fixing tool 5 in the above direction.

Moreover, at the time of a recording action for the record medium S, the head unit 3 is shifted downward along the support base 6 as shown in FIG. 1, and made such the condition that a recording head 10 (refer to FIG. 2) located at the lower side of the head unit 3 opposes to the recording medium S. On the other hand, at the time of setting a recording medium S or a maintenance or in the case that there is no service time until the next recording action after the current recording action has been completed, the head unit is shifted upward such that an operation is conducted to cover the recording head 10 with a cap (not sown in the drawing).

Here, in this embodiment, it is supposed that the head unit 3 is shifted manually upward or downward along the support base 6. However, it is also possible to constitute such that the head unit 3 is shifted mechanically by being driven by a drive motor.

In the vicinity of the head unit 3 on the platen 2, there is provided an intermediate tank unit 7 to store temporarily ink supplied from an ink cartridge (not shown in the drawing) which stores the ink to be jetted out from the recording head 10. Into an ink supply port 71 of the intermediate tank unit 7, ink is supplied from an ink cartridge through a tube (not shown in the drawing), stored temporarily in the intermediate tank unit 7, and fed from an ink outlet port 72 to a head unit through a flexible tube if required.

Here, in FIG. 1 and FIG. 2 mentioned later, an illustration of electric lines to supply power to the head unit 3 or to transmit signals with regard to ink jetting, is omitted. However, actually, the electric lines are appropriately connected to each member in such a way that a necessary control such as ink jetting control can be conducted for the recording head 10 of the head unit 3 by a computer (not shown in the drawing).

Figure 2:
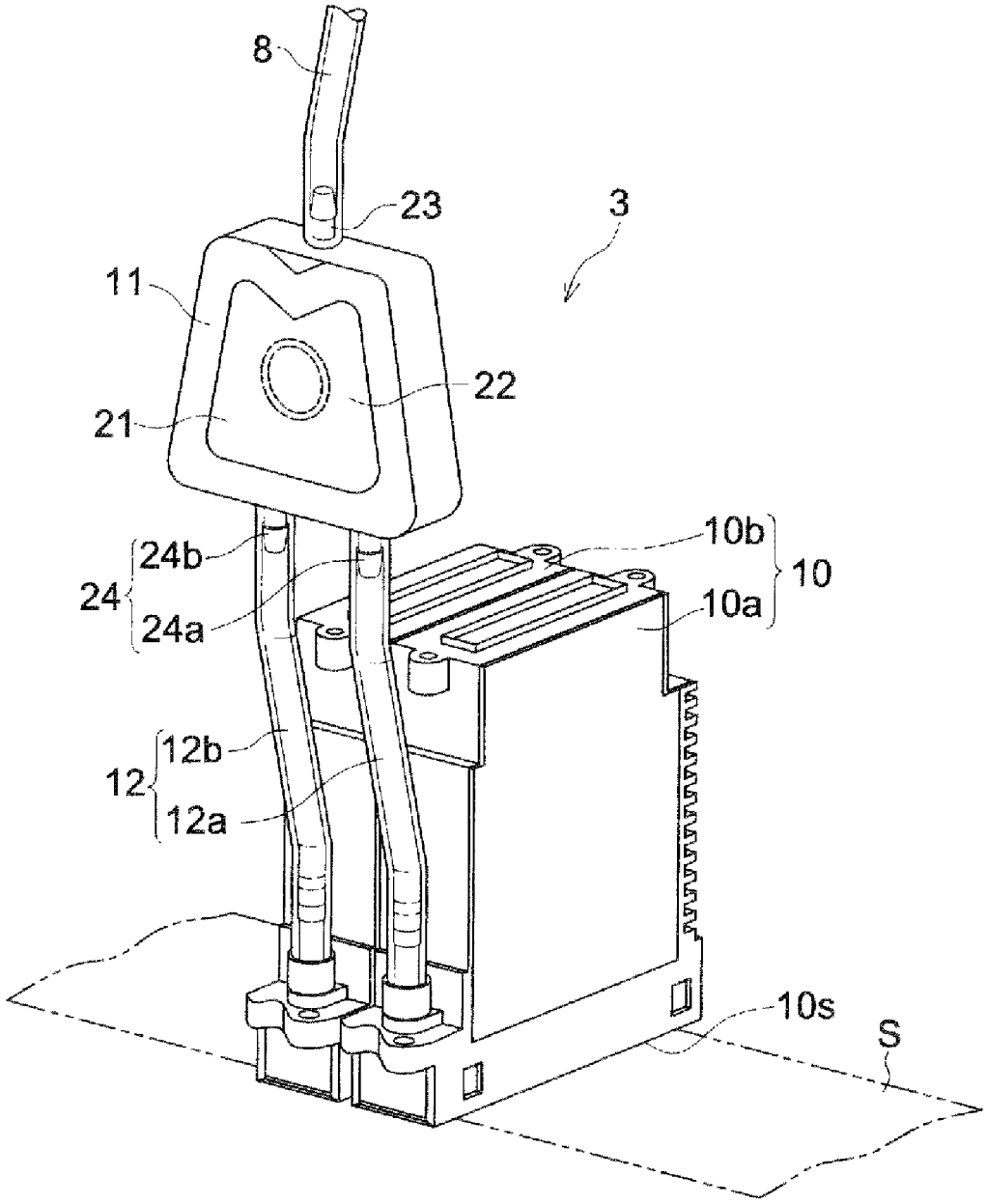
FIG. 2 is a drawing showing a structure of a head unit on the condition that a cover is removed.

The structure of the head unit 3 on the condition that a cover 3*a* is removed from the head unit 3 is shown in FIG. 2. FIG. 2 is a drawing in which the head unit 3 in FIG. 1 is viewed from the intermediate tank unit 7 side.

The head unit 3 is constituted by plural recording heads 10, a damper 11 to supply ink to these plural recording heads 10, ink supply pipes 12 to connect them. In this embodiment, the head unit 3 is equipped with two recording heads 10*a* and 10*b* as the plural recording heads 10, and ink is supplied to the two recording heads 10*a* and 10*b* through two ink supply pipes 12*a* and 12*b*, respectively from the damper 11.

In the recording heads 10*a* and 10*b* to 10*s*, on a surface (nozzle surface) opposing a record medium S at the lower side (lower by about 1 mm in this embodiment) of the recording heads, there are provided plural nozzles (not shown in the drawing) such that ink is jetted out from the nozzles to a record medium S being conveyed to record (printing) characters, images, and the like on the record medium S.

In the damper 11, an ink chamber 21 is formed in its inside, and, a damper sheet 22 having flexibility is formed on one side surface of the ink chamber 21. Here, in FIG. 2, circles shown with dotted line at the center of the damper sheet 22 represents the position where an elastic member 26 mentioned later is attached to the damper sheet 22.

Further, an ink inlet port 23 is formed at the upper side of the damper 11, and as mentioned above, ink supplied from the intermediate tank unit 7 flows into the ink chamber 21 through the flexible tube 8 and the ink inlet port 23. At the lower side of the damper 11, ink outlet ports 24 are formed. As the ink outlet ports 24, plural ink outlet ports 24*a* and 24*b* (two pieces in this embodiment) are provided corresponding to the number of the plural recording heads 10. The ink outlet ports 24*a* and 24*b* are connected to the recording heads 10*a* and 10*b* through respective ink supply pipes 12*a* and 12*b* mentioned above.

Thus, in this embodiment, the damper 11 is structured as a so-called branch type damper to supply separately or distribute ink supplied through one ink inlet port 23 from the intermediate tank unit 7 into the plural recording heads 10*a* and 10*b* to jet ink of the same color.

Figure 3:
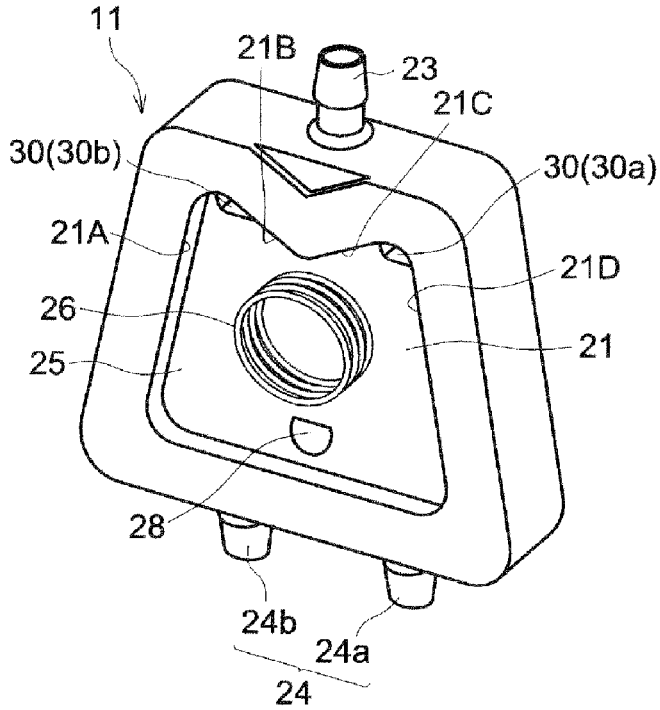
FIG. 3(A) is a perspective view showing a damper on the condition that a damper sheet is removed and FIG. 3(B) represents a front view of the damper.
Figure 3:
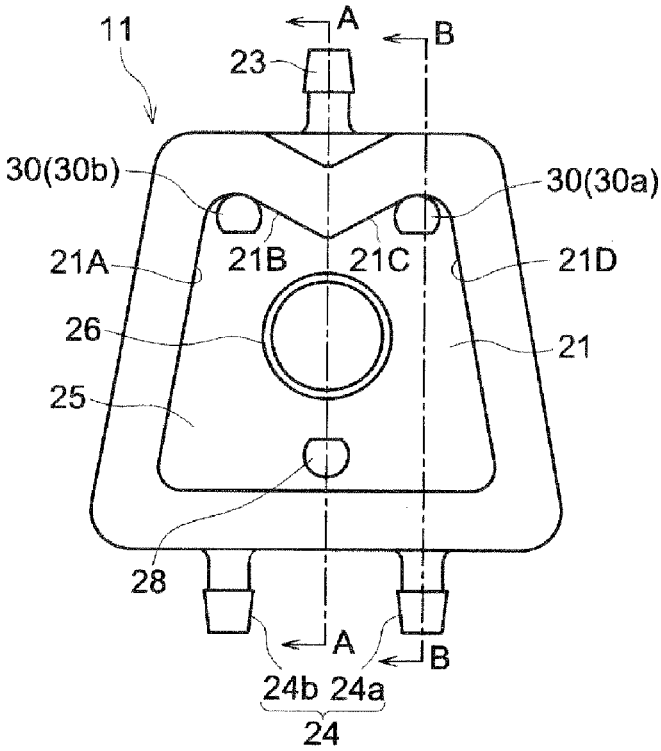
Figure 4:
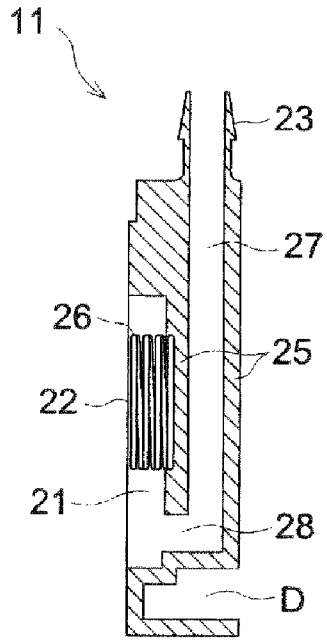
FIG. 4(A) represents a cross sectional view along a A-A line in FIG. 3(B)
FIG. 4(B) represents a cross sectional view along a B-B line in FIG. 3(B).
Figure 4:
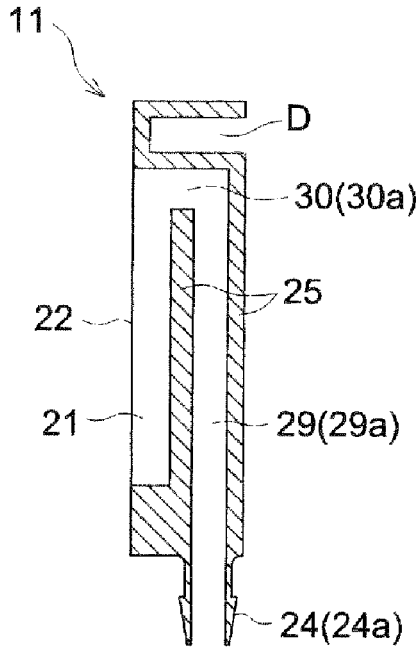

FIG. 3 is a drawing showing the damper on the condition that the damper sheet is removed, and FIG. 3(A) represents a perspective view and FIG. 3(B) represents a front view. Further, FIG. 4(A) represents a cross sectional view along an A-A line in FIG. 3(B), and FIG. 4(B) is a cross sectional view along a B-B line in FIG. 3(B).

Here, FIGS. 4(A) and 4(B) show the condition that the damper sheet 22 exists. Further, in the below, the front hand side in the drawing of FIG. 3(A) and FIG. 3(B) and the left side (namely, the side in which the damper sheet 22 exists) in the drawing of FIG. 4(A) and FIG. 4(B) are explained as the front side of the damper 11 for convenience. Also, the rear side in the drawing of FIG. 3(A) and FIG. 3(B) and the right side (namely, the side opposite to the side in which the damper sheet 22 exists) in the drawing of FIG. 4(A) and FIG. 4(B) are explained as the rear side of the damper 1.

In the damper 11, a concave portion having an opening section is formed in its front side, and the opening section is closed by the damper sheet 22 having flexibility so as to form the ink chamber 21. Thus, the damper sheet 22 forms one side surface at the front side of the ink chamber 21.

Further, at almost a center portion of the wall surface (hereafter, referred to as an ink chamber back surface) 25 opposite to the side surface formed by the damper sheet 22 in the ink chamber 21, the elastic member 26 constituted by a spring as one example is attached so as to face toward the inside of the ink chamber 21, and an end of the elastic member 26 opposite to the end attached to the ink chamber back surface 25 is attached to the damper sheet 22.

On the usual condition that ink is supplied from the intermediate tank unit 7 to the plural recording heads 10*a* and 10*b* through the damper 11 and an ink jetting operation becomes possible, the pressure in the ink chamber 21 of the damper 11 becomes slightly negative pressure to atmospheric pressure. However, on the nature of the damper sheet 22 to expand or contract so as to absorb pressure fluctuation at the time the inside pressure of the recording heads 10*a* and 10*b* and the flexible tube 8 is increased or decreased, it is necessary for the damper sheet 22 on the usual condition to be a so-called neutral condition that the damper sheet 22 does not expand or contract as shown in FIG. 4(A) and FIG. 4(B).

For this reason, since the inside of the ink chamber 21 is a slightly negative pressure for atmospheric pressure in the usual condition as mentioned above and the damper sheet 22 tends to contract by being pushed by the atmospheric pressure (that is, the damper sheet 22 tends to bend toward the ink chamber back surface 25 side), the elastic member 26 pushes the damper sheet 22 toward the outside to make the damper sheet 22 to maintain its neutral position.

On the ink chamber back surface 25, an ink inlet pipe (inlet conduit) 27 is formed so as to extend downward from the ink inlet port 23 of an inlet section provided at the upper side of the damper 11, and the ink inlet pipe 27 is bent toward the inside of the ink chamber 21 at the lower end portion in the ink chamber 21, and has an opening section (as the above mentioned entrance port) 28 to open to the ink chamber 21.

Moreover, in the inside of the ink chamber back surface 25, ink outlet pipes (outlet conduits) 29*a* and 29*b* (the ink outlet pipe 29*b* is not shown) are formed so as to extend upward respectively from plural ink outlet ports 24*a* and 24*b* of an outlet section provided at the lower portion of the damper 11, and the ink outlet pipes 29*a* and 29*b* are bent toward the inside of the ink chamber 21 at the top end portion in the ink chamber 21 respectively, and have each opening sections (as the above mentioned exit port) 30*a* and 30*b* to open to the ink chamber 21.

Here, the ink inlet pipe 28 and the ink outlet pipe 30 (30*a*, 30*b*) are shaped respectively in the form of a pipe having an inside diameter with the same size as that of the respective ink inlet port 23 and ink outlet ports 24 (24*a*, 24*b*), and do not communicate with each other in the ink chamber back surface 25. Further, the portion of D in FIG. 4(A) and FIG. 4(B) is a concave portion provided in order to reduce the weight of the damper 11, and has nothing to do with the flow of ink.

In this embodiment, in the ink chamber 21 of the damper 11, inner wall surfaces 21A, 21B, 21C and 21D are provided respectively so as to incline toward respective opening sections 30*a* and 30*b* of the ink outlet pipes 29*a* and 29*b* provided at the top end portion of the ink chamber 21.

Namely, at least in an upper portion among the inner space constituting the ink chamber 21, in order to structure the inner space to protrude upward in the form of a crest and in the form of almost sawtooth, the inner wall surfaces 21A, 21B, 21C, and 21D are provided respectively to incline, except the damper sheet 22 and the ink chamber back surface 25 among the inner wall surface including the inner wall surfaces 21A, 21B, 21C, and 21D, the damper sheet 22 and the ink chamber back surface 25 to divide the ink chamber 21 from the outside. Further, the port of each opening sections 30*a* and 30*b* of the respective ink outlet pipes 29*a* and 29*b* is provided at the position of respective apexes of the inner space protruding in the form of a crest.

Figure 5:
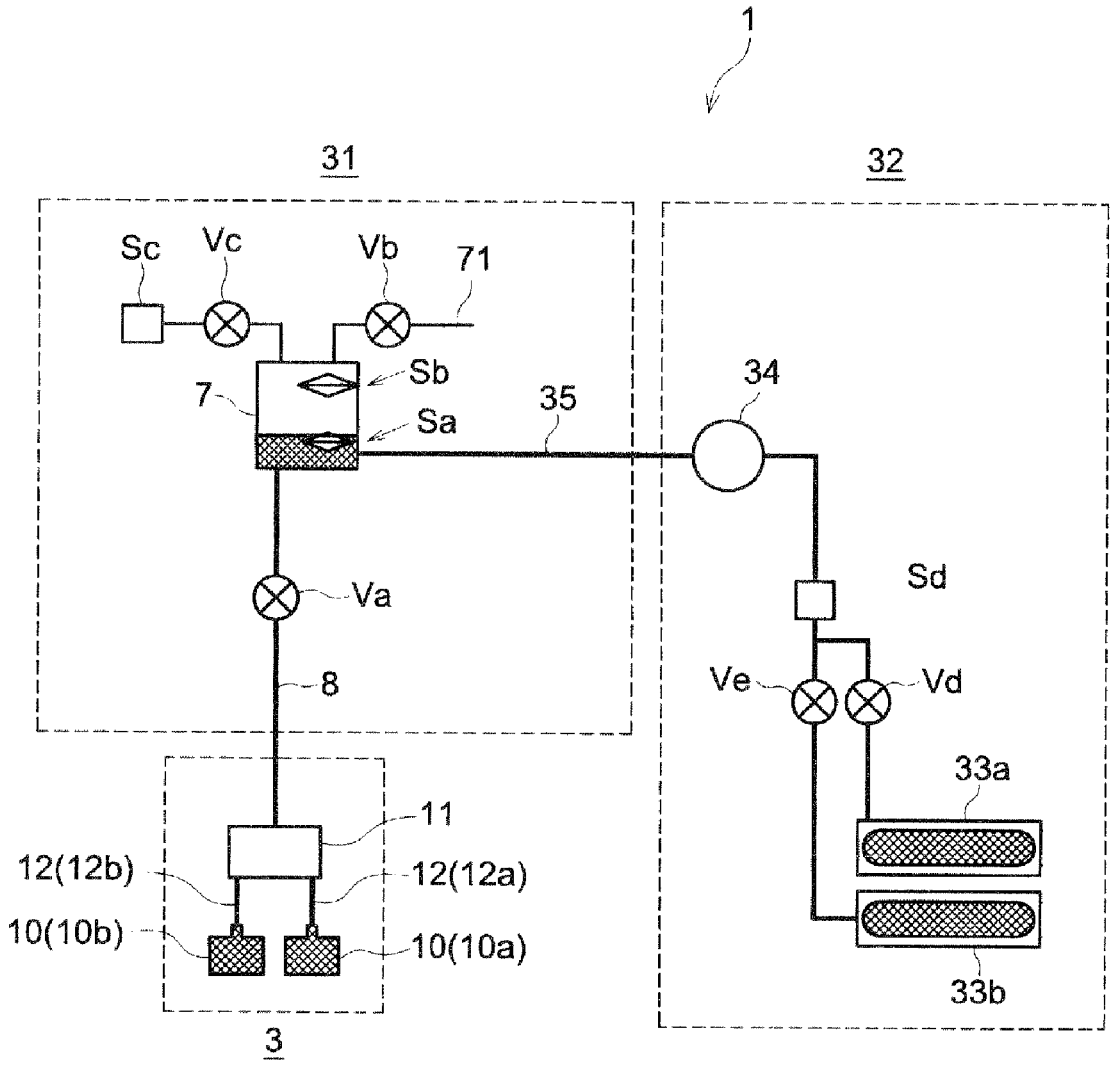
FIG. 5 is a drawing showing the entire configuration of the ink jet printer according to this embodiment.

As shown in FIG. 5, as the entire configuration, the ink jet printer 1 is constituted by a pressure control section 31 to adjust and control the back pressure of ink supplied to the head unit 3 equipped with the plural recording heads 10 (10*a*, 10*b*) and the damper 11 as mentioned above and an ink supply section 32 to supply ink to the head unit 3 through the pressure control section 31

Here, the entire configuration shown in FIG. 5 is a structure for each color ink. Therefore, in a color printing using plural different color inks, the structure shown in FIG. 5 is provided for each color ink. Further, in FIG. 5, illustrations of electric lines to supply power to each member of the head unit 3, the pressure control section 31 and the ink supply 32 and to transmit signals with regard to ink jetting, are omitted.

In the pressure control section 31, there is provided the intermediate tank unit 7 mentioned above, and on the flexible tube 8 which connects the intermediate tank unit 7 and a head unit 3 and is a flow path to supply ink, there is provided an opening and closing valve Va.

In the intermediate tank unit 7, as a sensor to detect the amount of ink stored in its inside by the position of the liquid level of ink, there are provided a liquid level reference position sensor Sa to detect whether the liquid level of ink is positioned above or below a predetermined reference position and a liquid level upper limit sensor Sb provided above the liquid level reference position sensor Sa so as to detect whether or not the liquid level of ink exceeds the upper limit, that is, the upper limit of the amount of stored ink.

Moreover, on the intermediate tank unit 7, there are provided a discharge tube 71 and an opening and closing valve Vb to discharge air in its inside into atmosphere; a back pressure sensor Sc to detect the pressure of inner air or a back pressure of ink jetted from the plural recording heads 10 (10*a*, 10*b*); and a protective valve Vc to protect the back pressure sensor Sc so as not to be applied with an excessive pressure.

In this embodiment, the ink supply section 32 is provided with plural ink cartridges 33*a* and 33*b*, and these ink cartridges 33*a* and 33*b* are communicated with the liquid feeding pump 34 through the communicating valve Vd and Ve. Among the communicating valve Vd and Ve, for example, a communicating valve at the side for the ink cartridge which is currently being used is opened, and a communicating valve at the side for a ink cartridge having been used is closed. Then, while the communicating valve is closed, the ink cartridge having been used is exchanged to an ink cartridge having been not used.

The liquid feeding pump 34 can send a predetermined amount of ink to the intermediate tank unit 7 in the pressure control section 31 through a liquid feeding pipe 35, or can return ink back from the intermediate tank unit 7 to the ink cartridge side. Further, in this embodiment, at a location between the ink cartridges 33*a* and 33*b* and the liquid feeding pump 34, there is provided an ink sensor Sd to detect the pressure in the ink passage at the location so as to detect whether ink is normally supplied from either of the ink cartridges 33*a* and 33*b*.

Next, actions of the ink jet printer 1 according to this embodiment will be explained.

In the ink jet printer 1 according to this embodiment, ink is supplied from the ink supply 32 shown in FIG. 5. The back pressure of the ink is controlled by the pressure control section 31, and the ink is supplied from the intermediate tank unit 7 to the head unit 3 through the flexible tube 8. As shown in FIG. 2, the ink supplied to the head unit 3 is supplied to the damper 11 of the head unit 3, and flows into the damper 11 from the ink inlet port 23 provided at the upper side of the damper 11

As shown in FIG. 3(A), FIG. 3(B), FIG. 4(A) and FIG. 4(B), the ink flowed in from the ink inlet port 23 of the damper 11 proceeds downward in the inside of the ink inlet pipe 27 formed in the ink chamber back surface 25 of the damper 11, and flows into the ink chamber 21 from the opening section 28. And then, the ink having flowed in from the opening section 28 by having been pushed by ink having flowed in subsequently proceeds upward in the inside of the ink chamber 21.

As mentioned above, since inner wall surfaces 21A, 21B, 21C, and 21D are provided at the upper portion of the ink chamber 21 so as to incline toward the opening sections 30*a* and 30*b* of the ink outlet pipes 29*a* and 29*b* respectively, the ink proceeding upward in the inside of the ink chamber 21 is guided toward the opening sections 30*a* and 30*b* by the inner wall surfaces 21A, 21B, 21C, and 21D, and is discharged from the opening sections 30*a* and 30*b* to the ink outlet pipes 29*a* and 29*b*. At this stage, the ink flow is branched toward the recording heads 10*a* and 10*b*.

The ink having flowed separately into the ink outlet pipes 29*a* and 29*b* proceeds downward in the inside of the ink outlet pipes 29*a* and 29*b*, passes through the ink outlet ports 24*a* and 24*b*, and is supplied to the two recording heads 10*a* and 10*b* through the ink supply pipes 12*a* and 12*b* respectively (refer to FIG. 2). Then, the inside of each of the recording heads 10*a* and 10*b* is filled with the ink, and also the plural nozzles provided on each nozzle surfaces 10*s* of each of the recording heads 10*a* and 10*b* is filled with the ink, whereby the preparation of an image recording is completed.

As mentioned above, at the time of recording, at the time of maintenance, or at the time of conducting a process to cover nozzles of the recording heads 10*a* and 10*b* with a cap in the case of standby, if the recording heads 10*a* and 10*b* is shifted upward or downward, or if an impact force is applied onto pipes (flexible tube 8 and the like) to supply ink to the recording heads 10*a* by touching the pipes, the pressure in the recording head recording head 10*a* and 10*b* may fluctuate.

In that case, when the inside of the recording heads 10*a* and 10*b* become under a reduced pressure state, ink is supplied from the damper 11 to the recording heads 10*a* and 10*b*, or when the inside of the recording heads 10*a* and 10*b* become under an increased pressure state, ink is returned from the recording heads 10*a* and 10*b* to the damper 11. As a result, the inside pressure of the recording heads 10*a* and 10*b* may be maintained always almost at a constant.

Especially, at the time of using high viscosity ink, a jetting action may be performed by heating the ink in the recording head 10*a* and 10*b*. In this case, when there is time until the following recording action, the heating of ink is interrupted temporarily. Then, when the expanded volume of ink by the heating becomes small due to the lowering of the temperature, the inside of the recording heads 10*a* and 10*b* may become in a reduced pressure state. However, even in this case, ink is supplied appropriately from the damper 11 to the recording heads 10*a* and 10*b*, whereby the inside pressure of the recording heads 10*a* and 10*b* may be maintained always almost at a constant. As a result, the inflow of outside air from the nozzles can be prevented.

Further, when air enters in the ink chamber 21 of the damper 11 due to a certain cause, air is collected into the upper portion of the ink chamber 21. However, as described above, since ink flows so as to proceed upward from the opening section 28 provided in the lower end part toward the opening sections 30*a* and 30*b* formed in the upper end portion in the ink chamber 21, the air collected in the upper portion of the ink chamber 21 is easily discharged from the opening sections 30*a* and 30*b* to the ink outlet pipes 29*a* and 29*b*, and is sent to the recording heads 10*a* and 10*b* through the ink supply pipes 12*a* and 12*b*.

Therefore, at the time of maintenance, by an operation to jet ink from the nozzles of the recording heads 10*a* and 10*b* by applying a pressure to the inside of the intermediate tank unit 7, or by an operation to draw out ink from the nozzle side by suction, the air collected in the ink chamber 21 of the damper 11 is easily discharged out from the nozzles of the recording heads 10*a* and 10*b*, whereby air in the damper 11 can be removed easily.

Moreover, the ink inlet port 23 through which ink is supplied from the intermediate tank unit 7 to the damper 11 is formed at the upper side of the damper 11, and the ink outlet ports 24*a* and 24*b* through which ink is discharged from the damper 11 to the recording heads 10*a* and 10*b* are formed at the lower side of the damper 11. Therefore, it becomes possible to circulate ink in accordance with the natural flow of liquid which flows from a high place to a low place, and it becomes unnecessary to apply an unnecessary pressure to ink. Further, it becomes possible to prevent occurrence of unnecessary pressure fluctuation caused by applying an unnecessary pressure to ink.

As mentioned above, according to the ink jet printer 1 related to this embodiment, the damper 11 is made to a so-called branch type to branch and supply ink supplied through one ink inlet port 23 from the intermediate tank unit 7 to the plural recording heads 10*a* and 10*b* to jet out ink of the same color. Therefore, it becomes possible to structure such that the pressure of ink in the plural recording heads 10*a* and 10*b* to jet out ink of the same color can be regulated by one piece of the damper 11.

Accordingly, the plural recording heads 10*a* and 10*b* to jet out ink of the same color become to have the same ink pressure. As a result, since the amount of the ink jetted out from each of the recording heads 10*a* and 10*b* becomes equal, it becomes possible to prevent appropriately color unevenness from occurring in a recorded image.

Moreover, since it is allowed to provide one piece of the damper 11 to plural recording heads 10*a* and 10*b*, it becomes possible to prevent the tendency to make the size of the ink jet printer 1 itself larger. Also, it becomes possible to reduce the manufacturing cost and the exchange cost of the damper 11.

Furthermore, like the ink jet printer 1 according to this embodiment, with the structure of the ink chamber 21 of the damper 11 that ink flows into the ink chamber 21 from its lower end portion and flows out from the top end portion of the ink chamber 21, air collected in the upper portion of the ink chamber 21 is easily pushed out from the damper 11 by utilizing the flow of ink within the ink chamber 21, and it becomes possible to remove air by discharging the air from the nozzles of the recording heads 10*a* and 10*b*.

Here, in this embodiment, as shown in the FIG. 2, the explanation is made about the case that two recording heads 10*a* and 10*b* are arranged side by side, and the flow of ink is branched and supplied into the two recording heads 10*a* and 10*b* by the damper 11. However, the number of the recording head 10 is not limited to two pieces.

Figure 6:
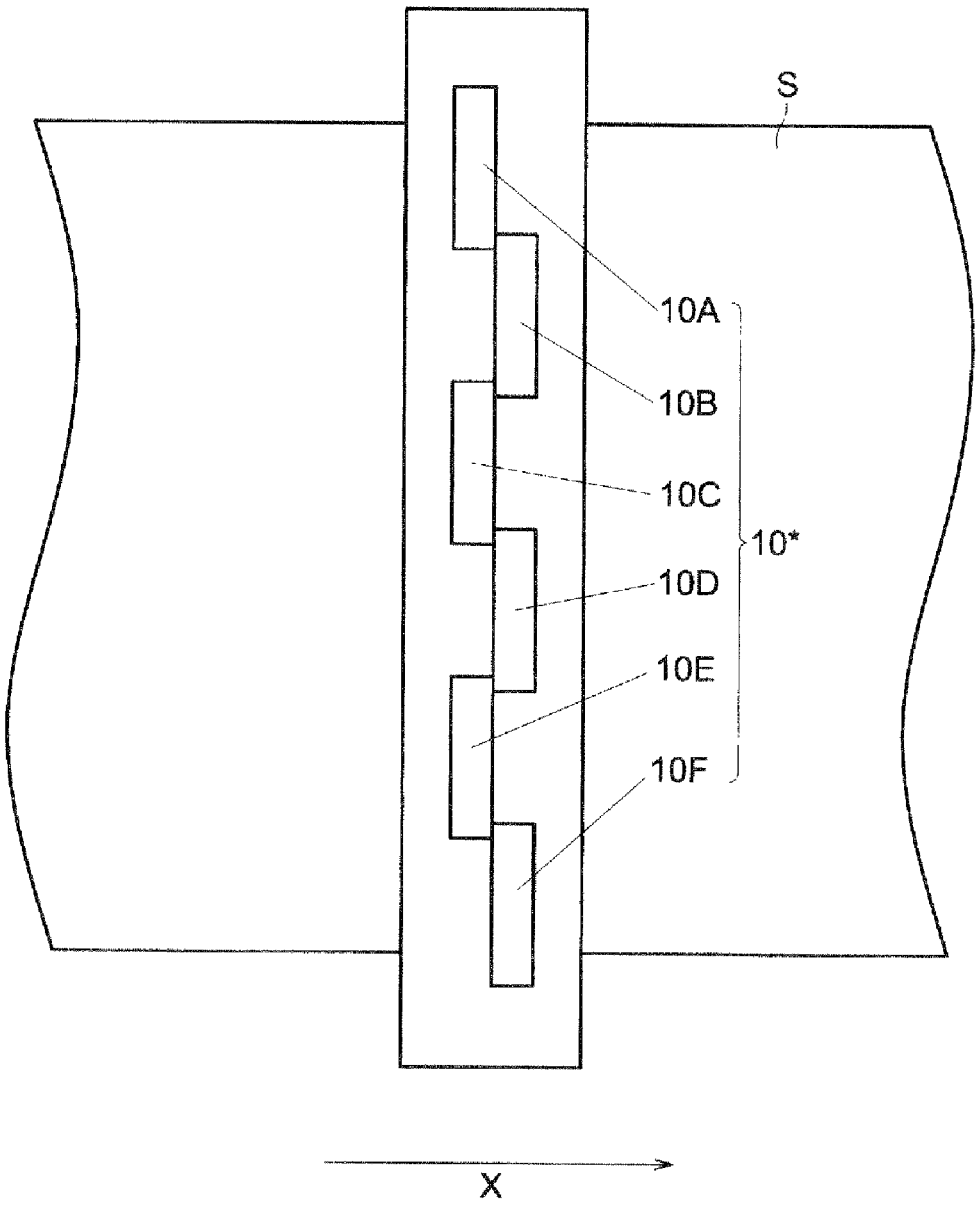
FIG. 6 is an outline plan showing a modification example in the case that plural recording heads are formed as a recording unit.
Figure 7:
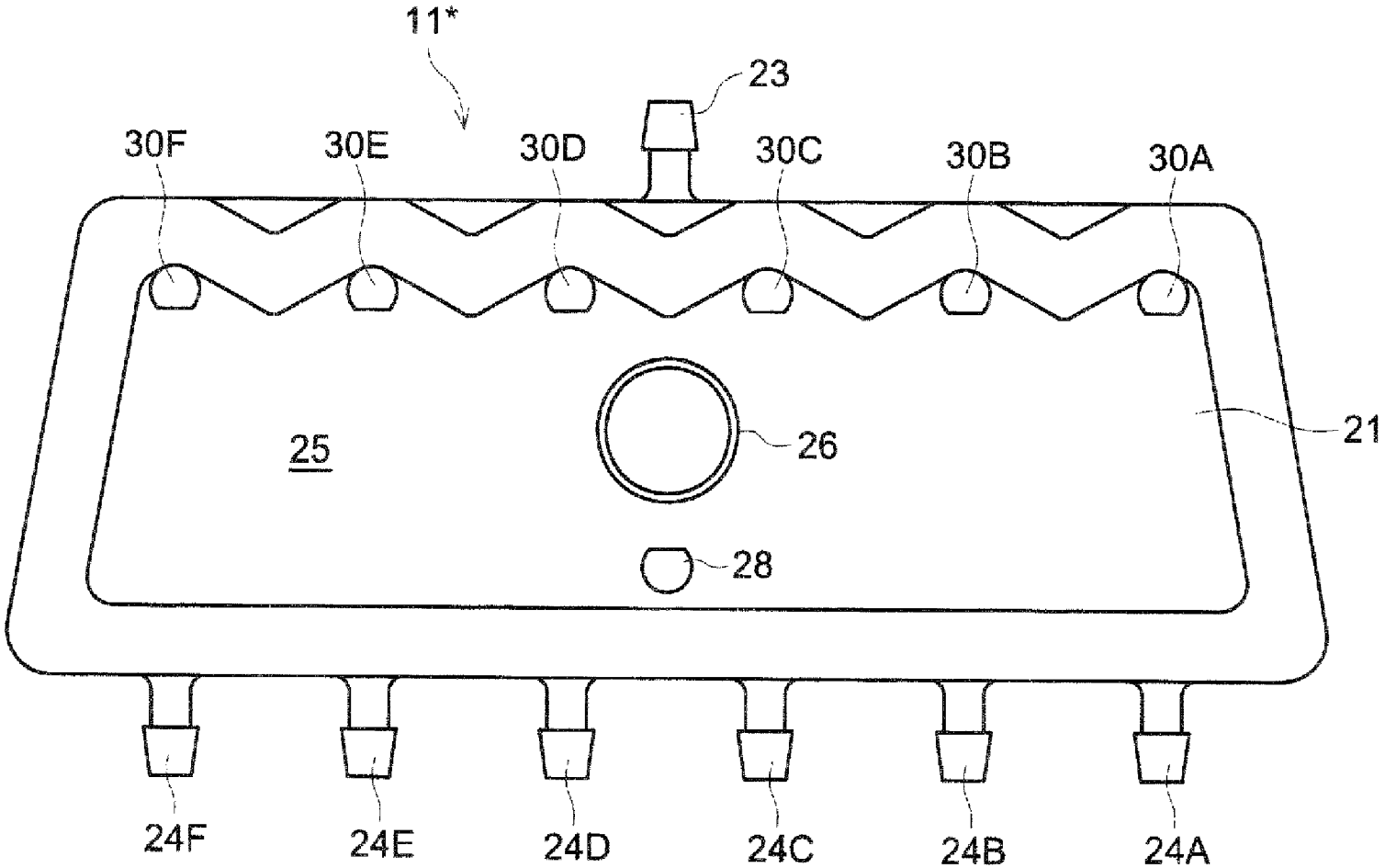
FIG. 7 is a front view showing the modification example of a damper.

In a line head type ink jet printer of, for example, as shown in FIG. 6, there is a case in which plural recording heads 10A-10F to jet ink of the same color are arranged in a direction perpendicular to the conveying direction X in an staggered layout for example to form one recording-unit 10*. In such a case, as shown in FIG. 7, it is possible to constitute a damper 11* so as to comprise six opening sections 30A to 30F and ink outlet ports 24A to 24F for on ink inlet port 23 (opening section 28). The ink outlet ports 24A-24F are connected to plural recording heads 10A to 10F through respective ink supply pipes (whose illustration is omitted).

If a recording unit is constituted in this way, even in the case that a line head type ink jet printer is equipped with six recording heads 10A-10F, it becomes possible to branch and supply ink supplied through one ink inlet port 23 from the intermediate tank unit 7 into plural recording heads 10*a* and 10*b* to jet ink of the same color by the damper 11* as same as this embodiment, and it becomes possible to acquire the same effectiveness as this embodiment. In that case, it is desirable to provide an inner wall surface inclining toward opening sections 30A-30F provided at the top end portion of an ink chamber 21 of a damper 11* as same as this embodiment.

Figure 8:
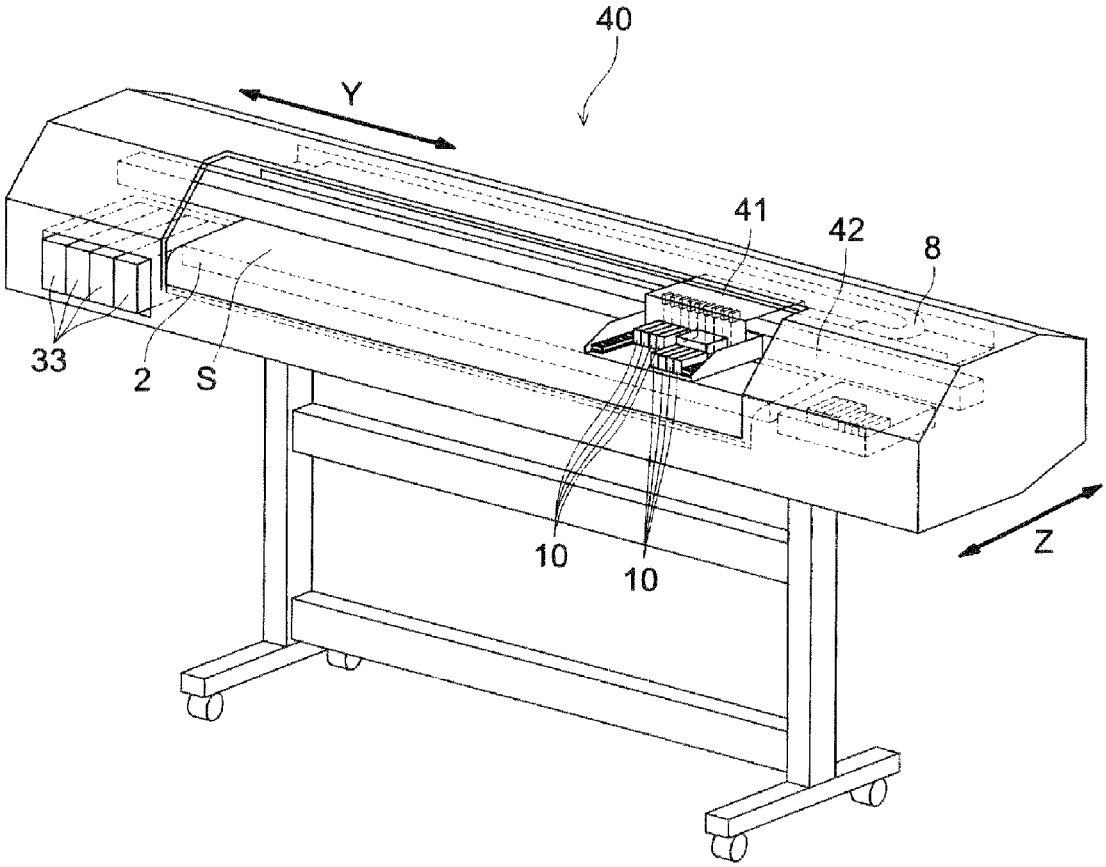
FIG. 8 is a perspective view showing the entire configuration of a serial head type ink jet printer.

Moreover, in this embodiment and the modification example, the explanation is made about the case where an ink jet printer is a line head type. However, it is also possible to apply the present invention to a serial head type ink jet printer 40 as shown in FIG. 8.

In the serial head type ink jet printer 40, plural recording heads 10 jet out ink from nozzles (not illustrated in the drawing) to a record medium S supported by a platen 2 from its non recording surface side, whereby an image is recorded (printed) on the record medium S. However, the recording head 10 jets out ink to conduct the recording while the recording head 10 is moving outward and homeward above the record medium S which is stopped on the platen 2.

Concretely, in the serial head type ink jet printer 40, each recording head 10 is usually mounted in the box-shaped carriage 41, and the carriage 41 is moved outward and homeward in a main scanning direction Y along a guide rail 42, whereby each recording head 10 is moved outward and homeward on the record medium S.

In the above structure, for example, ink is jetted out from the predetermined nozzles of each recording head 10 so as to record images of a specified width on the record medium S while the carriage 41 is moved in one direction in the main scanning direction Y along the guide rail 42 above the record medium S on the condition that it is stopped. Thereafter, the record medium S is conveyed by only a predetermined distance in the sub scanning direction Z perpendicular to the main scanning direction Y, and is stopped again. And then, ink is jetted out from the predetermined nozzles of each recording head 10 so as to record images of a specified width on the record medium S while the carriage 41 is moved in the direction opposite to the previous moving direction along the guide rail 42. An image is recorded on the record medium S while such actions are being repeated.

In the serial head type ink jet printer 40, as the plural recording heads 10 mounted on the carriage 41, it is possible to employ a head unit 3 (refer to FIG. 2) or a recording-unit 10* (refer to FIG. 6) constituted by plural recording heads which are shown in the above-mentioned embodiment.

At this time, by employing the damper 11 as shown in FIG. 3(A) to FIG. 4(B) or the damper 11* as shown in FIG. 7 as a damper, even in the serial head type ink jet printer 40, it becomes possible to acquire the completely same effectiveness as the case of the line head type ink jet printer in the above-mentioned embodiment and the modification example.

Here, the kind of ink is not limited specifically in this embodiment or the modification example. Further, in the case of using photo-curable ink as ink, a light irradiating device for irradiating light to make ink harden is arranged suitably.

What is claimed is:

1. An inkjet printer, comprising:

a plurality of recording heads to jet ink onto a recording medium;

an ink distributing device to distribute the ink to the plurality of recording heads, the ink distributing device having a damping effect on the ink, the ink distributing device including:

an ink chamber to store the ink therein;

an inlet section comprising an ink inlet port through which the ink is fed from an outside into the ink chamber; and an outlet section comprising a plurality of ink outlet ports through which the ink is discharged from the ink chamber; and a plurality of supplying pipes to distribute the ink from the plurality of outlet ports to the plurality of recording heads, wherein the ink inlet port is located at an upper side of the ink distributing device and the plurality of ink outlet ports are located at a lower side of the ink distributing device, wherein the outlet section has a plurality of exit ports at an upper end of the ink chamber and a plurality of outlet conduits which connect the plurality of exit ports with the plurality of ink outlet ports, and wherein the ink chamber has an inner wall surface which is inclined toward the plurality of exit ports provided at the upper end.

2. The inkjet printer described in claim 1, wherein the ink chamber is provided with an opening section on one side wall surface thereof, wherein the ink distributing device further comprises a flexible damper sheet which covers the opening section, and an elastic member, and wherein one end of the elastic member is fixed on a wall surface of the ink chamber located opposite to the opening section and another end of the elastic member opposite to the fixed one end is adapted to urge the flexible damper sheet toward the outside.

3. The inkjet printer described in claim 1, wherein the inlet section has an entrance port at a lower end of the ink chamber and an inlet conduit which connects the entrance port with the ink inlet port.

4. The inkjet printer described in claim 3, wherein the ink distributing device is structured such that the ink fed through the ink inlet port proceeds downward in the inlet conduit, enters in the ink chamber through the entrance port, circulates upward in the ink chamber, is distributed by the plurality of exit ports, proceeds downward in the plurality of outlet conduits, and is discharged through the plurality of ink outlet ports.

5. The inkjet printer described in claim 1, wherein each of the plurality of recording heads is a line head type recording head.

6. The inkjet printer described in claim 5, wherein the plurality of recording heads are provided in a recording unit in which the plurality of recording heads are arranged side by side in a direction perpendicular to a conveying direction of the recording medium.

7. The inkjet printer described in claim 1, wherein each of the plurality of recording heads is a serial head type recording head.

* * * * *